US008640519B2

(12) United States Patent
Kubo

(10) Patent No.: US 8,640,519 B2
(45) Date of Patent: Feb. 4, 2014

(54) PRESS-MOLDING MOLD, AND PRESS-MOLDING METHOD

(75) Inventor: Masao Kubo, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 378 days.

(21) Appl. No.: 12/674,074

(22) PCT Filed: Aug. 5, 2008

(86) PCT No.: PCT/JP2008/064024

§ 371 (c)(1),
(2), (4) Date: Feb. 18, 2010

(87) PCT Pub. No.: WO2009/025171

PCT Pub. Date: Feb. 26, 2009

(65) Prior Publication Data

US 2011/0100085 A1 May 5, 2011

(30) Foreign Application Priority Data

Aug. 20, 2007 (JP) ..... 2007-214013

(51) Int. Cl.
*B21D 22/21* (2006.01)

(52) U.S. Cl.
USPC ..... 72/351; 72/347; 72/350

(58) Field of Classification Search
USPC ..... 72/347, 348, 350, 351
See application file for complete search history.

(56) References Cited

U.S. PATENT DOCUMENTS

| | | | | | |
|---|---|---|---|---|---|
| 1,892,754 | A * | 1/1933 | Tarbox | ..... | 72/378 |
| 2,843,071 | A * | 7/1958 | Kitzinger | ..... | 72/351 |
| 3,263,637 | A * | 8/1966 | Cox | ..... | 72/347 |
| 3,733,880 | A * | 5/1973 | Hansson | ..... | 72/344 |
| 4,611,481 | A * | 9/1986 | Radtke | ..... | 72/347 |
| 6,474,126 | B1 * | 11/2002 | Webster | ..... | 72/348 |
| 6,807,838 | B2 * | 10/2004 | Iwaya | ..... | 72/350 |

FOREIGN PATENT DOCUMENTS

| | | |
|---|---|---|
| JP | 2547772 | 12/1988 |
| JP | 8 25097 | 1/1996 |
| JP | 2000 102824 | 4/2000 |

* cited by examiner

*Primary Examiner* — Dana Ross
*Assistant Examiner* — Lawrence Averick
(74) *Attorney, Agent, or Firm* — Oblon, Spivak, McClelland, Maier & Neustadt, L.L.P.

(57) ABSTRACT

Provided are a press-molding mold, in which cracks and wrinkles to be formed at the corner portions of a press-molded article are reduced regardless of the depth of the drawing, and a press-molding method using that mold. The press-molding mold (1) comprises a die (2) having a recess (2*b*) and a wrinkle holding face (2*a*) formed around the recess (2*b*), a punch (3) having a protrusion (3*a*) matching the recess (2*b*), and a blank holder (4) having a cushion face (4*a*) matching the wrinkle holding face (2*a*). In the press-molding mold (1), the wrinkle holding face (2*a*) and the cushion face (4*a*) form a clamping portion (14), by which a material member (5) is clamped for the press-molding operation. The clamping portion (14) of the press-molding mold (1) is divided by an opening portion (15) communicating with a corner recess (2*c*) of the recess (2*b*), into a first clamping portion (14*a*) and a second clamping portion (14*b*), by which the material member (5) is clamped.

3 Claims, 9 Drawing Sheets

(b) PRIOR ART (a)

(b) PRIOR ART

PRESS-MOLDING MOLD, AND PRESS-MOLDING METHOD

TECHNICAL FIELD

The present invention relates to a technique of press molding, especially to a press mold and a press molding method for reducing cracks and wrinkles to be formed at the corners of a molded article.

BACKGROUND ART

Conventionally in press molding, the molded articles have corner portions, which are easy to form cracks or wrinkles, and the molded articles having the cracks or wrinkles are scrapped. So, before producing the press mold, the examination of the die-face design, the simulating evaluation and the like are carried out so as not to form the cracks or wrinkles.

However, after producing the press mold and performing the prototype molding, there are many cases that the examination and the like does not work.

Thus, some modifications are needed to produce the press mold that will not form the cracks and wrinkles, but the modifications cost much money and time.

The press molding using the conventional press mold is described below, referring FIGS. 4 to 9. In FIGS. 4, 8, 9, for convenience, a die 32 as an upper mold is not shown and they illustrate plan views seeing through the die 32.

Here, describing the terms used in below explanations, a drawing profile 21 illustrated by the broken lines in FIGS. 4, 5, is the border between a punch 33 as a lower mold and a blank holder 34 in plan view. Parting lines 22 illustrated by two-dotted lines are the borders between the product parts and the removed parts in the blank. That is, the part inner than the parting lines 22 is used as a product and that outer than the parting lines 22 is cut off.

In the area surrounded by the drawing profile 21 and an outline 23 of the blank, a clamping portion 37 is defined by a blank holding face 32*a* and a cushion face 34*a*. The clamping portion 37 holds the blank 35 with applying the inflow resistance to the blank 35 in the hatched area depicted in FIG. 4.

As shown in FIGS. 5, 6, a conventional press mold 31 has the die 32, the punch 33, and the blank holder 34.

In the pressing method called cushion drawing, FIG. 5(*a*) shows a first step mounting the blank 35 on the blank holder 34.

FIG. 5(*b*) shows a second step moving the die 32 downwardly and clamping a periphery 35*a* of the blank 35 by the clamping portion 37, that is the face 32*a* of the die 32, and the face 34*a* of the blank holder 34.

FIG. 6(*a*) shows a third step moved down the cushion face 34*a* in response to the pressure from the die 32, with holding the periphery 35*a* of the blank 35 by the clamping portion 37.

FIG. 6(*b*) shows a forth step pressing the blank 35 by a projection 33*a* of the punch 33, with the projection 33*a* facing a recess 32*b* of the die 32. The blank 35, clamped by the portion 37, flows into a cavity 36 defined by the projection 33*a* and the recess 32*b* in the arrow B1 and B2 directions, and plastically deforms along the shape of the projection 33*a* and the recess 32*b*. As shown in FIG. 7, the plastic deformation of the blank 35 is the curvature at the portions pointed by the numerals M1, M2 and the stretch by the length L. In this manner, the blank 35 is deformed to form the three-dimensional molded article.

As shown in FIGS. 4, 8, the clamping portion 37, which is configured by the faces 32*a*, 34*a* and clamps the periphery 35*a* of the blank 35, is formed in L shape to continuously surround a corner portion 35*b* of the blank.

In such a case, when the corner portion 35*b* is formed, as shown in FIG. 8, the inflow of the blank 35 is concentrated from the two sides (R side and S side depicted in FIG. 8) toward a corner recess 32*c*, as a result, the periphery 35*a* outer than the corner portion 35*b* (in detail, the area T in FIG. 8) is pressed to compress ("the contraction forming").

Thus, as shown in FIG. 9, in the periphery 35*a* outer than the corner portion 35*b* (in detail, the area T in FIGS. 8, 9), the thickness increases.

The increase of the thickness in the periphery 35*a* (in the area T) results in the increase of the inflow resistance, so that the cracks and wrinkles are formed around the corner portion 35*b* (in detail, the area U in FIG. 9).

Further, when setting the curvature radius of the corner portion 35*b* as small value, the increase of the inflow resistance becomes high, and the curvature radius needs to be set as a proper value, which limits the designs.

To prevent the cracks and wrinkles at the corner portion of the molded article, the die is modified such that the blank holding face has a bead and the corner of the face has a projection and recess, whereby increasing the resistance against the wrinkles of the blank flowing into the corner portion, and preventing the cracks and wrinkles. For instance, Patent Literature 1 discloses such a technique.

Such a conventional technique unfortunately fails to prevent the cracks and wrinkles at the corner portion of the molded article if the drawing depth of the article is large.

[Patent Literature 1] JP H8-25097 A

DISCLOSURE OF INVENTION

Problems to be Solved by the Invention

The objective of present invention is to provide an unexpected press mold enabled to reduce cracks and wrinkles formed at the corner portions of a molded article regardless of the depth of the drawing, and a press molding using the press mold.

Means of Solving the Problems

The first aspect of the present invention is a press mold for press molding a blank, including a die provided with a recess and a blank holding face formed around the recess; a punch provided with a projection corresponding to the recess; and a blank holder provided with a cushion face corresponding to the blank holding face, in which the blank holding face and the cushion face define a clamping portion, which clamps the blank, and the clamping portion is divided into a first clamping portion and a second clamping portion by an opening portion communicating to a corner portion of the recess.

In the preferable embodiment of the present invention, the first and second clamping portions comprising arc portions, each of which arranged at the opening portion side, the each arc portion being as a part of a drawing profile which is a border between the punch and the blank holder.

In the advantageous embodiment of the present invention, the arc portions curves in opposite directions each other toward an edge of the blank.

The second aspect of the present invention is a press molding using a press mold including a die provided with a recess and a blank holding face formed around the recess, a punch provided with a projection corresponding to the recess, a blank holder provided with a cushion face corresponding to the blank holding face, and a clamping portion defined by the blank holding face and the cushion face, the press molding is performed with clamping a blank by the clamping portion, in which the clamping portion is divided into a first clamping portion and a second clamping portion by an opening portion communicating to a corner portion of the recess.

In the preferable embodiment of the present invention, the first and second clamping portions comprising arc portions, each of which arranged at the opening portion side, the each arc portion being as a part of a drawing profile which is a border between the punch and the blank holder.

In the advantageous embodiment of the present invention, the arc portions curves in opposite directions each other toward an edge of the blank, and the arc portions apply inflow resistances to parts of the blank disposed at the opening portion.

Effect of the Invention

According to the first aspect of the present invention, the concentration of the inflow of the blank toward the corner portions. Thus, the reduction of the cracks and wrinkles are provided. Furthermore, the blank disposed at the opening portion is not clamped and the holding force is lowered, so that the deep drawing can be easily applied.

The modifications of the inflow resistance of the blank improve the thickness reduction rate of the molded article.

According to the press mold of the present invention, the inflow resistance applied to the blank is modified and the inflow toward the corner portion is dispersed.

According to the press mold of the present invention, it becomes possible to apply the inflow resistance to the blank disposed at the opening portion.

According to the second aspect of the present invention, the concentration of the inflow of the blank toward the corner portions. Thus, the reduction of the cracks and wrinkles are provided. Furthermore, the blank disposed at the opening portion is not clamped and the holding force is lowered, so that the deep drawing can be easily applied.

The modifications of the inflow resistance of the blank improve the thickness reduction rate of the molded article.

According to the press mold of the present invention, the inflow resistance applied to the blank is modified and the inflow toward the corner portion is dispersed.

According to the press mold of the present invention, it becomes possible to control the inflow amount of the blank disposed at the opening portion.

THE BEST MODE FOR CARRYING OUT THE INVENTION

Figure 1:
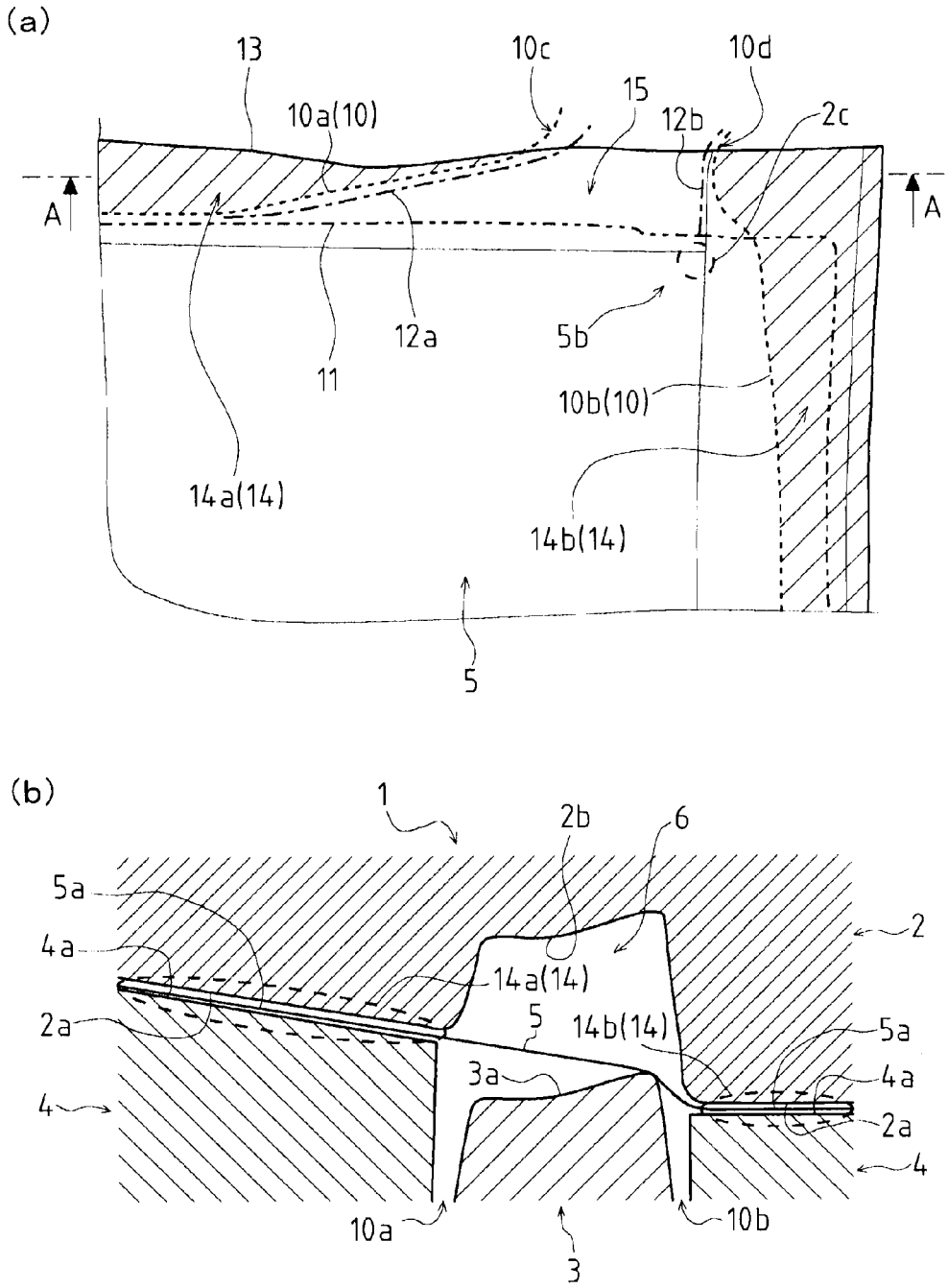
FIG. 1 is a partial schematic view showing a molding of a corner portion using a press mold; (a) depicts the plan view, (b) depicts the A-A line section view.
Figure 2:
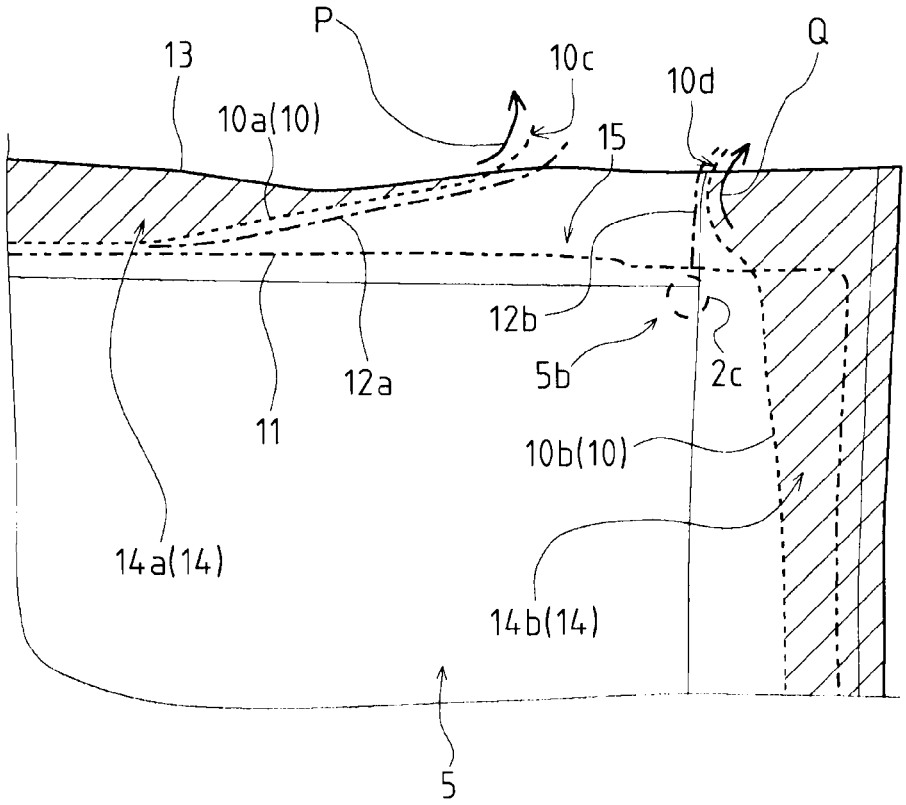
FIG. 2 is a partial schematic plan view showing the molding of the corner portion.
Figure 3:
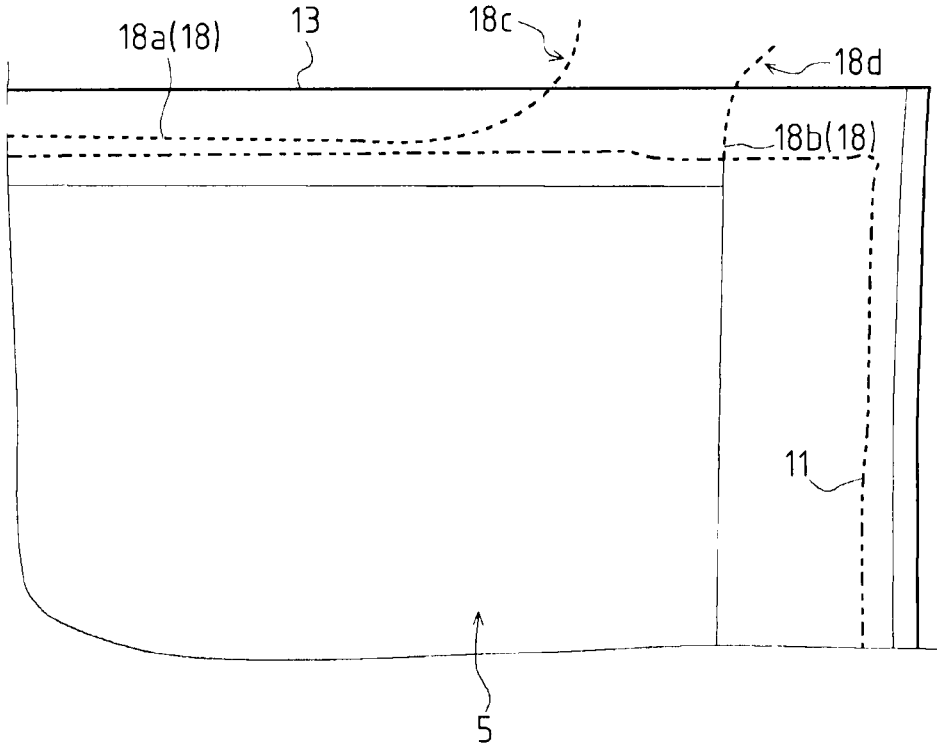
FIG. 3 is a partial schematic plan view showing the molding of the corner portion when the blank is small.

Explained is a press molding using a press mold according to the present invention, referring FIGS. 1 to 3. In FIGS. 1(*a*), 2, 3, for convenience, a die 2 as an upper mold is not shown and illustrated plan views seeing through the die 2. In the embodiment, the press molding employs the cushion drawing as the conventional press molding method.

As shown in FIG. 1(*b*), a press mold 1 has the die 2 as the upper mold, a punch 3 as a lower mold, and a blank holder 4.

In the press molding, a thin plate material (blank) 5 is set on the blank holder 4, the die 2 moves downward, and the periphery 5*a* of the blank 5 is clamped by a blank holding face 2*a* of the die 2 and a cushion face 4*a* of the blank holder 4 (that is, a clamping portion 14), at the same time, the cushion face 4*a* moves downward in response to the pressure from the die 2.

The blank 5 is pressed by a projection 3*a* of the punch 3, with the projection 3*a* facing a recess 2*b* of the die 2. The blank 5, clamped by the portion 14, flows into a cavity 6 defined by the projection 3*a* and the recess 2*b*, and plastically deforms (curves or stretches) along the shape of the projection 3*a* and the recess 2*b*, thereby produced as a three-dimensional mold.

In the embodiment, the cushion drawing is employed as the press molding. however, the press molding according to the present invention is not limited to that molding method.

The press mold used for the press molding as the present invention differs from the conventional mold in setting method of the drawing profile, in which the present invention has a technical feature.

As shown in FIG. 1(*a*), the press mold 1 has a drawing profile 10 as a border between the punch 3 and the blank holder 4 in plan view. The profile 10, in plan view, is divided into a first drawing profile 10*a* and a second drawing profile 10*b* by an opening portion 15. In other words, the press mold 1 has the first profile 10*a* and second profile 10*b* as the drawing profile 10 divided by the opening portion 15 in plan view. Also, the mold has a parting line 11 set as the conventional one. In the press molding, pad edges 12*a*, 12*b* are set along the profiles 10*a*, 10*b*. The "pad edge" is an edge line showing the border of the pad portions remained at the press molding considering the press performance.

The first profile 10*a* is the border set in the upper portion of the blank 5 shown in FIG. 1(*a*), and the faces 2*a*, 4*a* define a first clamping portion 14*a* in the area surrounded by the profile 10*a* and an outline 13 of the blank. The second profile 10*b* is the border set in the right portion of the blank 5 shown in FIG. 1(*a*), and the faces 2*a*, 4*a* define a second clamping portion 14*b* in the area surrounded by the profile 10*b* and the outline 13.

As depicted in FIGS. 1(*a*), 1(*b*), in the mold 1, the faces 2*a* and 4*a* clamp the periphery 5*a* of the blank 5, in which the clamping portion 14 is divided into the first portion 14*a* and the second portion 14*b* around the corner recess 2*c* of the die.

Figure 4:
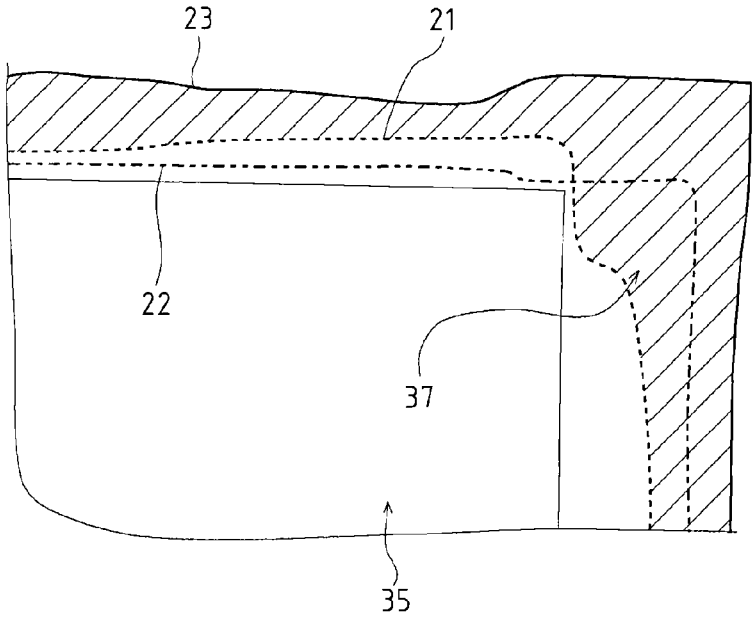
FIG. 4 PRIOR ART
FIG. 4 is a partial schematic view showing a molding of a corner portion using a conventional press mold.
Figure 5:
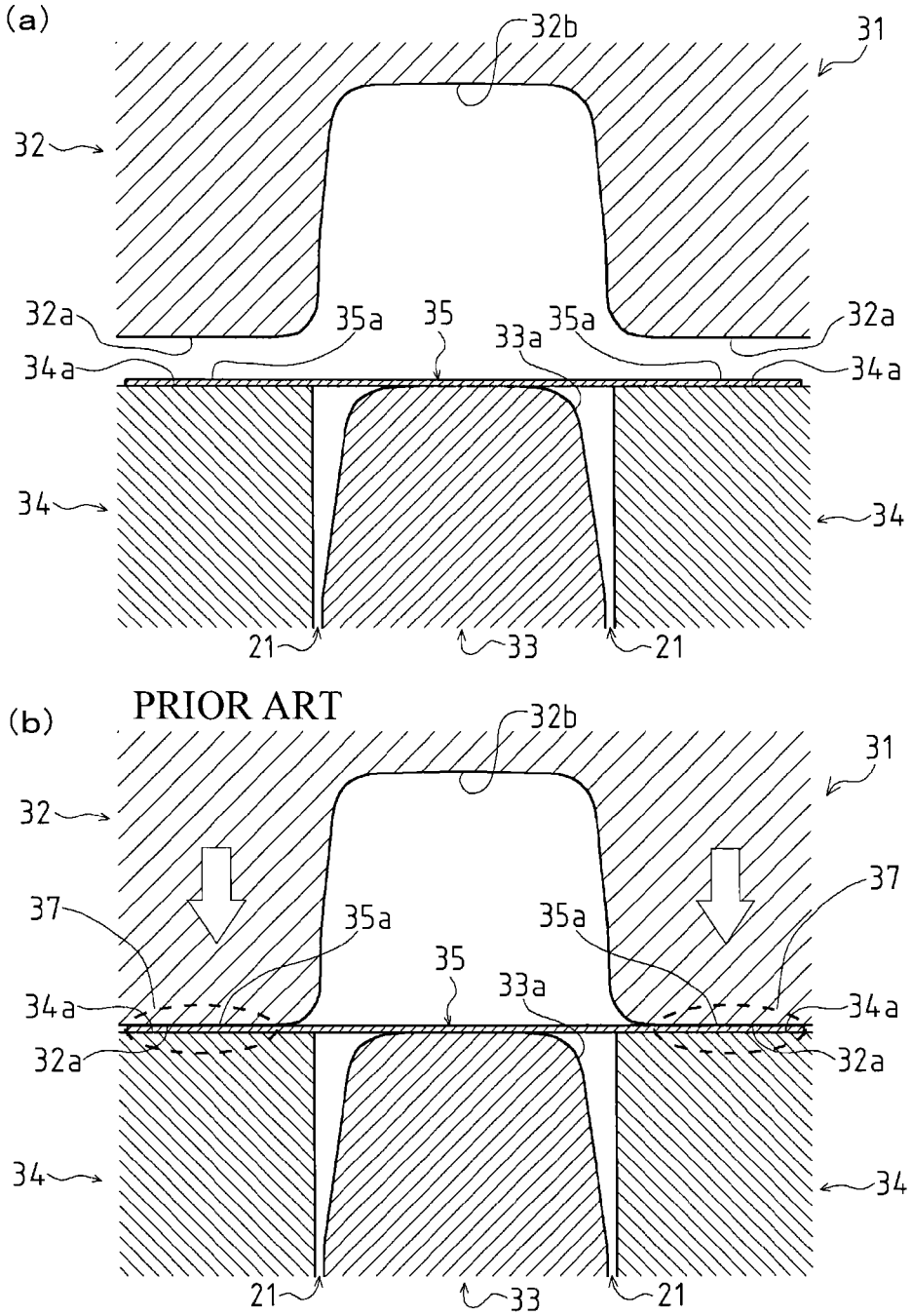
FIG. 5 PRIOR ART
FIG. 5 is a partial schematic view showing the molding of the conventional press mold; (a) depicts a first step, (b) depicts a second step.
Figure 6:
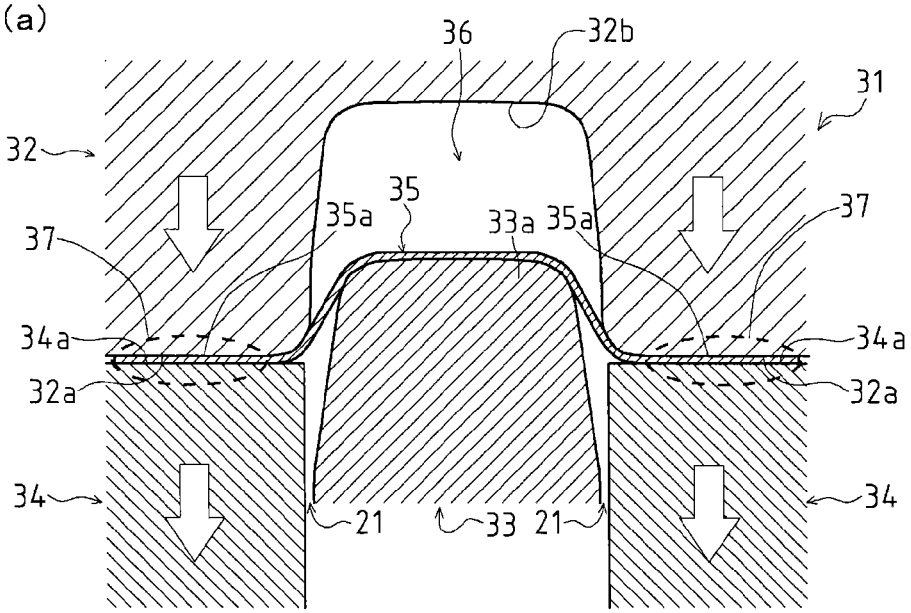
FIG. 6 PRIOR ART
FIG. 6 is a partial schematic view showing the molding of the conventional press mold; (a) depicts a third step, (b) depicts a forth step.
Figure 6:
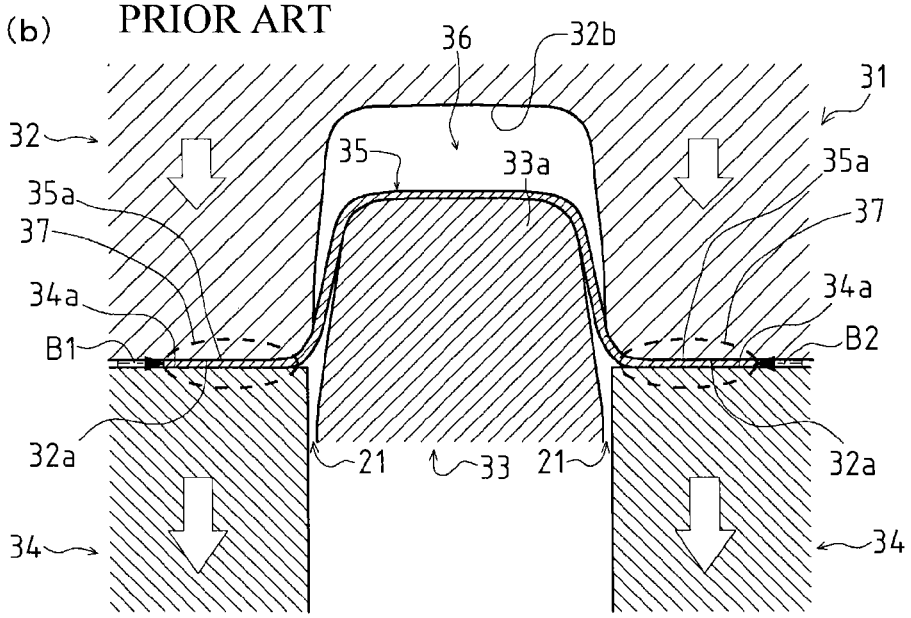
FIG. 6 PRIOR ART
Figure 7:
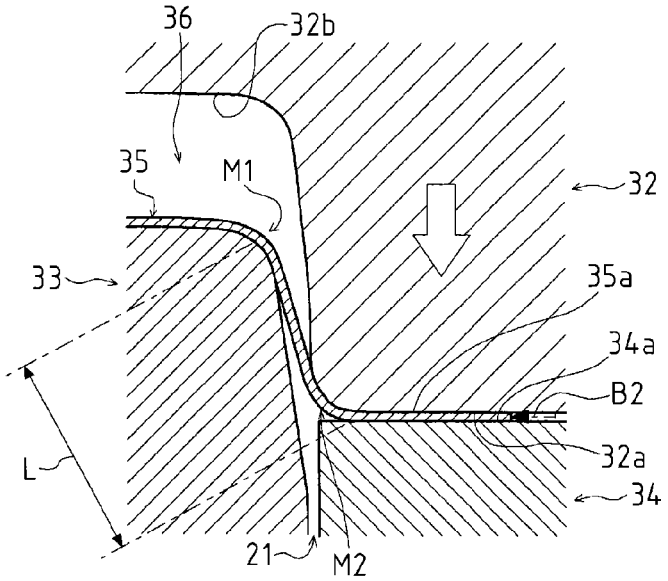
FIG. 7 PRIOR ART
FIG. 7 is a partial section view showing the deformation of the blank in the press molding using the conventional press mold.
Figure 8:
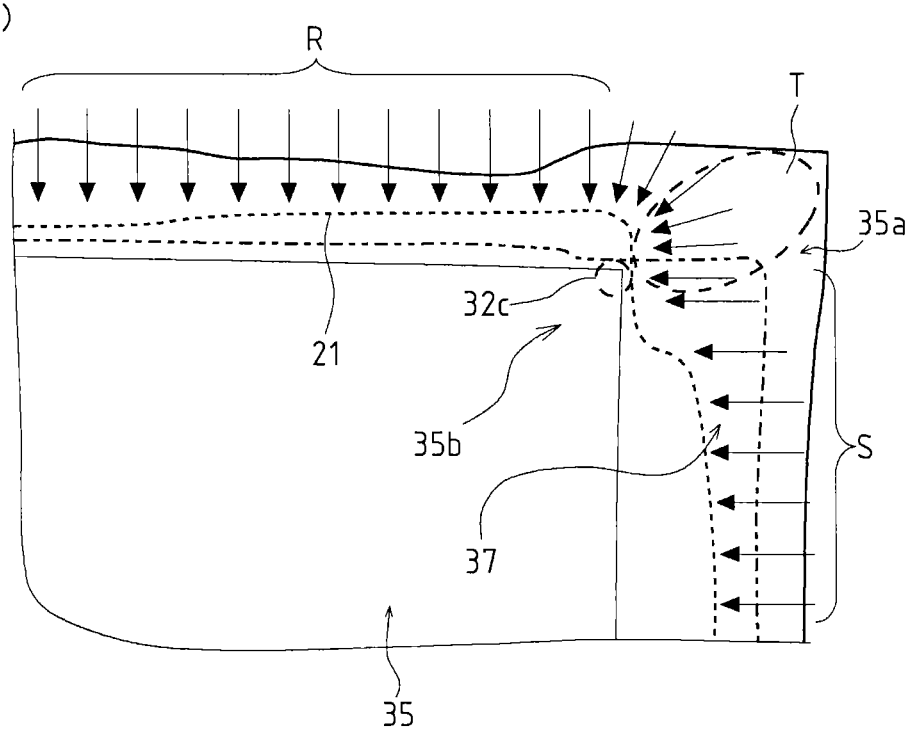
FIG. 8 PRIOR ART
FIG. 8 is a partial schematic view showing the molding of the corner portion using the conventional press mold; (a) depicts the plan view, (b) depicts the perspective view of the corner portion of the die.
Figure 8:
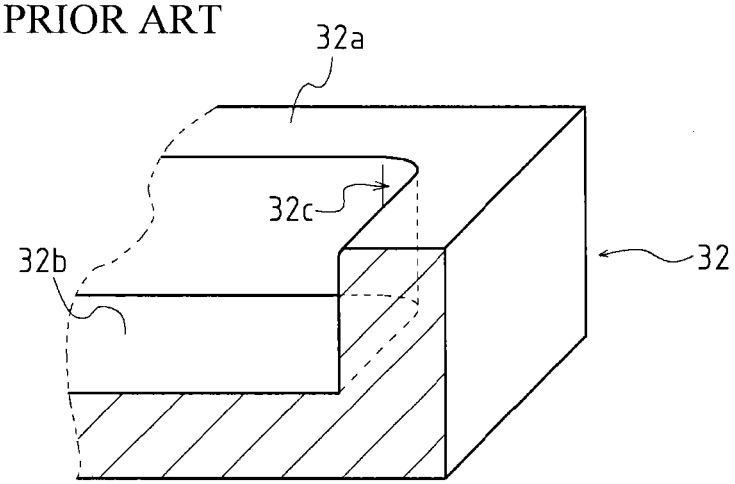
FIG. 8 PRIOR ART
Figure 9:
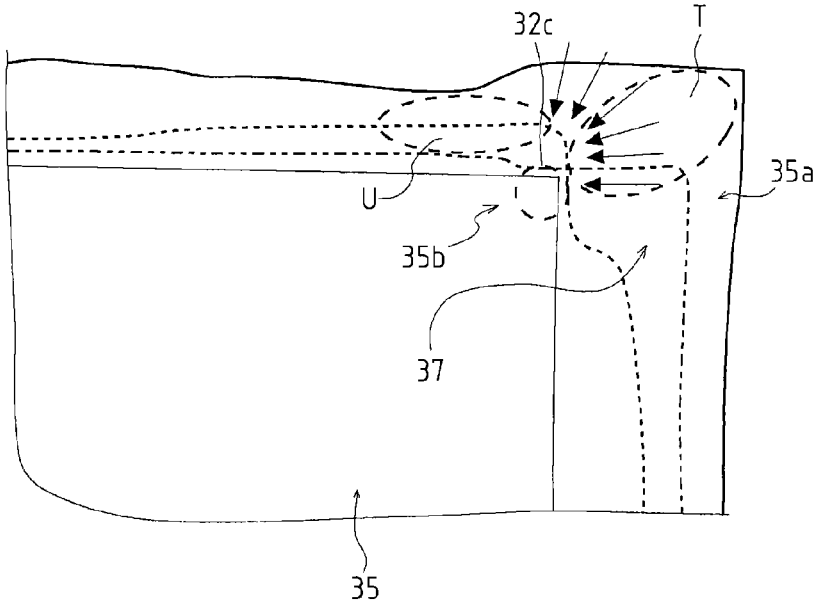
FIG. 9 PRIOR ART
FIG. 9 is a partial schematic view showing the defects formed in the corner portion of the molded article molded by the conventional press mold.

In the press molding using the press mold of the present invention, the clamping portion 14, the conventional embodiment of which (e.g. the portion 37 in FIG. 4) is configured in L shape and clamps the corner portions of the blank continuously, is divided into the first and second portions 14*a*, 14*b* by the opening portion 15, which does not clamp the blank 5, formed between the clamping portions 14*a* and 14*b*.

Due to the above structure, the inflow of the material toward the corner recess 2*c* is dispersed, whereby reducing the compressing force of the periphery 5*a* of the blank 5 at the corner recess 2*c;* as a result, the increase of the thickness in the periphery 5*a* is reduced.

Moreover, the reduction of the thickness increase of the periphery 5*a* makes the inflow resistance lowered and the cracks and wrinkles that are formed at the corner portion prevented.

Note that, in the embodiment, two sides forming the corner portion make around 90 degrees where the first and second profiles 10*a*, 10*b* are defined, however, there is no limitation in the angle made by the two sides forming the corner portion. For example, that angle may be an acute angle or an obtuse angle.

The press molding according to the present invention uses the press mold 1 having the die 2 provided with the recess 2*b* and with the blank holding face 2*a* formed around the recess 2*b*, the punch 3 provided with the projection 3*a* corresponding to the recess 2*b*, and the blank holder 4 provided with the cushion face 4*a* corresponding to the blank holding face 2*a*, in which the blank holding face 2*a* and the cushion face 4*a* defines the clamping portion 14, and the blank 5 is press formed with clamped by the clamping portion 14. The clamping portion 14 is divided into the first clamping portion 14*a* and the second clamping portion 14*b* by the opening portion 15 communicated to the corner recess 2*c* of the recess 2*b*, and the blank 5 is clamped by the first and second clamping portions 14*a*, 14*b*.

Due to the above structure, the inflow of the blank 5 is not concentrated to the corner recess 2*c*. Thus, the cracks and wrinkles are prevented. Further, the part of the blank 5 disposed at the opening portion 15 is not clamped and the holding force is lowered, so that the deep drawing can be easily applied. The modification of the inflow resistance of the blank 5 improves the thickness reduction rate of the molded article.

As shown in FIGS. 1, 2, the shape of the drawing profiles 10*a*, 10*b* are configured as arc shapes around the corner recess 2*c*. Additionally, the arc shapes are set through the outside of the edge line (outline 13) of the blank 5.

The arc portions 10*c*, 10*d* set in the edge of the blank 5 along the drawing profiles 10*a*, 10*b* are curved in the opposite direction each other in plan view. In detail, as shown in FIG. 2, the arc portion 10*c* formed in the profile 10*a* is curved in counter-clockwise direction (depicted as the arrow P in FIG. 2) toward the edge of the blank 5. The arc portion 10*d* formed in the profile 10*b* is curved in clockwise direction (depicted as the arrow Q in FIG. 2), which is opposite direction to the arrow P, toward the edge of the blank 5.

Due to the above structure, even in the part of the blank 5 disposed at the opening portion 15, the arcs of the die 2 (namely, arc portions 10*c*, 10*d* provided at the edge of the profiles 10*a*, 10*b*) act the inflow resistance, so that the inflow amount of the blank 5 at the opening portion 15 can be controlled. Further, the adjustment for the shapes of the arc portions 10*c*, 10*d* allows to control the inflow amount of the blank 5. In detail, to change the radiuses of the arc portions 10*c*, 10*d* into smaller values gives the higher inflow resistances to the blank 5.

The press mold 1 used for the press molding according to the present invention has the arc portions 10*c*, 10*d* as parts of the drawing profiles 10*a*, 10*b* formed in the clamping portions 14*a*, 14*b* at the side of the opening portion 15.

Thus, the inflow resistance applied to the blank 5 is modified and the material inflow toward the corner recess 2*c* is dispersed.

In the press mold 1, the arc portions 10*c*, 10*d* are curved in the opposite direction each other (in the arrow P direction and arrow Q direction) toward the edge of the blank 5. The press mold 1 provides the inflow resistance applied to the blank 5 by the arc portions 10*c*, 10*d/*

Due to the above structure, the inflow resistance is applied to the part of the blank 5 disposed at the opening portion 15 (namely, not clamped by the first and second clamping portions 14*a*, 14*b*), so that the inflow amount of the blank 5 disposed at the opening portion 15 can be controlled.

As shown in FIG. 3, when the blank 5 is downsized to improve the yield rate of the blank 5, the present invention preferably applied.

In such a case, a drawing profile 18 may be configured to omit the inclining portion adjacent to arc portions 18*c*, 18*d* and to form the arc portions 18*c*, 18*d* directly continued to drawing profiles 18*a*, 18*b* defined parallel to the parting line.

Industrial Applicability

The present invention is applicable to the press molding not only to the metal blanks but also to the materials such as resin or glass.

The invention claimed is:

1. A press mold for press molding a blank comprising:

a die provided with a recess and a blank holding face formed around the recess;

a punch provided with a projection corresponding to the recess; and a blank holder provided with a cushion face corresponding to the blank holding face, wherein the blank holding face and the cushion face define a clamping portion, which clamps the blank, wherein the clamping portion is divided into a first clamping portion and a second clamping portion by an opening portion communicating to a corner portion of the recess, and wherein the first and second clamping portions include arc portions, each of which are arranged at the opening portion side, each arc portion being as a part of a drawing profile which is a border between the punch and the blank holder, wherein each arc portion has an arc shape from an inside to an outside of the blank in plan view, wherein each of the arc shapes is set through an outline of the blank, and wherein the entire arc shape of the arc portions curves in opposite directions from each other toward an edge of the blank.

2. A press molding using a press mold having a die provided with a recess and a blank holding face formed around the recess, a punch provided with a projection corresponding to the recess, a blank holder provided with a cushion face corresponding to the blank holding face, and a clamping portion defined by the blank holding face and the cushion face, the press molding is performed with clamping a blank by the clamping portion, wherein the clamping portion is divided into a first clamping portion and a second clamping portion by an opening portion communicating to a corner portion of the recess, and wherein the first and second clamping portions include arc portions, each of which are arranged at the opening portion side, each arc portion being as a part of a drawing profile which is a border between the punch and the blank holder, wherein each arc portion has an arc shape from an inside to an outside of the blank in plan view, wherein each of the arc shapes is set through an outline of the blank, and wherein the entire arc shape of the arc portions curve in opposite directions from each other toward an edge of the blank.

3. The press molding according to claim 2, wherein the arc portions apply inflow resistances to parts of the blank disposed at the opening portion.

* * * * *